United States Patent [19]

Green et al.

[11] 4,092,642

[45] May 30, 1978

[54] PLURAL SENSOR MONITORING AND DISPLAY DEVICE

[75] Inventors: Douglas Harry Green, Blackpool; Joseph Pickup, Cleveleys, both of England

[73] Assignee: Delphic Limited, Douglas, England

[21] Appl. No.: 734,880

[22] Filed: Oct. 22, 1976

[51] Int. Cl.[2] ..... G08B 19/00

[52] U.S. Cl. ..... 340/413; 340/52 F; 340/411

[58] Field of Search ..... 340/52 F, 213 R, 214, 340/411, 412, 413, 414, 415

[56] References Cited

U.S. PATENT DOCUMENTS

| | | | |
|---|---|---|---|
| 3,944,969 | 3/1976 | Arai et al. | 340/52 F |
| 3,987,439 | 10/1976 | Spaniola | 340/413 |

*Primary Examiner*—Alvin H. Waring

*Attorney, Agent, or Firm*—Diller, Brown, Ramik & Wight

[57] ABSTRACT

A monitoring device for monitoring the outputs of a plurality of sensors and displaying appropriate information. The device has a plurality of input circuits for connection to the plurality of sensors. A scanning means is arranged to sequentially scan the input circuits to detect the presence of any activated sensor or sensors. A plurality of display devices sequentially display information corresponding to any activated sensor or sensors. The device also includes an integrity circuit which inhibits the actuation of the display devices for a predetermined period following detection of an activated sensor, whereby transient or random noise signals received by the input circuits are ineffective to activate the display devices.

14 Claims, 4 Drawing Figures

76
+V
N.C.
N.O.
0V
22
24
26

+V
M
34
36
9
8
7
6
5
4
3
2
1
0
B
N
30
66
64
68
70
38
+6·6V
72
+5V
74
0V
40
48
58
g
h
f
e
d
D
Z
y
x
U
V
W
÷5
÷6
46
50
44
52
54
60
62

PLURAL SENSOR MONITORING AND DISPLAY DEVICE

The present invention relates to monitoring devices and is particularly concerned with a monitoring device for monitoring the outputs of a plurality of sensors and displaying appropriate information.

A monitoring device is known in the art (U.S. Pat. No. 3,541,550 Hamre) which comprises a plurality of input gates connected to a plurality of sensors, scanning means in the form of a counter for sequentially scanning the input gates to open an appropriate input gate upon the detection of the presence of an activated sensor or sensors, and a plurality of display devices for sequentially displaying information corresponding to any activated sensor or sensors. The known device includes circuitry for stopping the scanner for a period upon the occurrence of an activated sensor so as to activate the display for a suitable period determined by a timing means.

One disadvantage of the known device is that the display devices can be momentarily activated upon the simultaneous occurrence of a scanning signal and a transient or random noise signal at an input gate whereby spurious flashing of the associated display is possible in the absence of a "true" sensor activation.

A further disadvantage of the known device, when used for monitoring fault conditions by said sensors, is that it is not able to distinguish between faults of differing importance so that a high priority fault is given the same display time as a fault of low priority.

It is an object of the present invention to provide a monitoring device which is only responsive to "true" sensor activation.

It is a further object of the present invention to provide an embodiment which is capable of distinguishing between fault conditions of different priority and assigning to such faults correspondingly different display times.

In accordance with the present invention, the monitoring device includes an integrity circuit for inhibiting the actuation of all of the display devices for a predetermined period following detection of an activated sensor, whereby transient or random noise signals received by the input circuits are ineffective to activate the display devices.

Where, for example, the sensors are adapted to respond to fault conditions, the monitoring device thus detects the occurrence of a "possible fault" and then waits for said predetermined period to establish whether the fault is "real" before displaying it. This prevents spurious, short duration transients or noise signals from tripping the display.

In some embodiments, it is advantageous for there to be at least two possible "weights" or information, important information being displayed for longer periods than information of lesser importance. Each individual item of information corresponding to a respective sensor is arranged to be displayed for a predetermined period of time, after which it is either repeated or replaced by the subsequent information item in the scanning sequence.

It is a considerable advantage in practice if each of the display devices comprises a display lamp having an associated optical system adapted, when the associated lamp is activated, to project onto a single, common screen visual information corresponding to an associated one of the sensors. This latter system is illustrated further in the aforementioned Hamre U.S. Pat. No. 3,541,550 and also in the U.K. Specifications Nos. 959,077 and 1,093,068 of Industrial Electronic Engineers, Inc.

The invention is described further hereinafter, by way of example, with reference to the accompanying drawings, in which.

Figure 1:
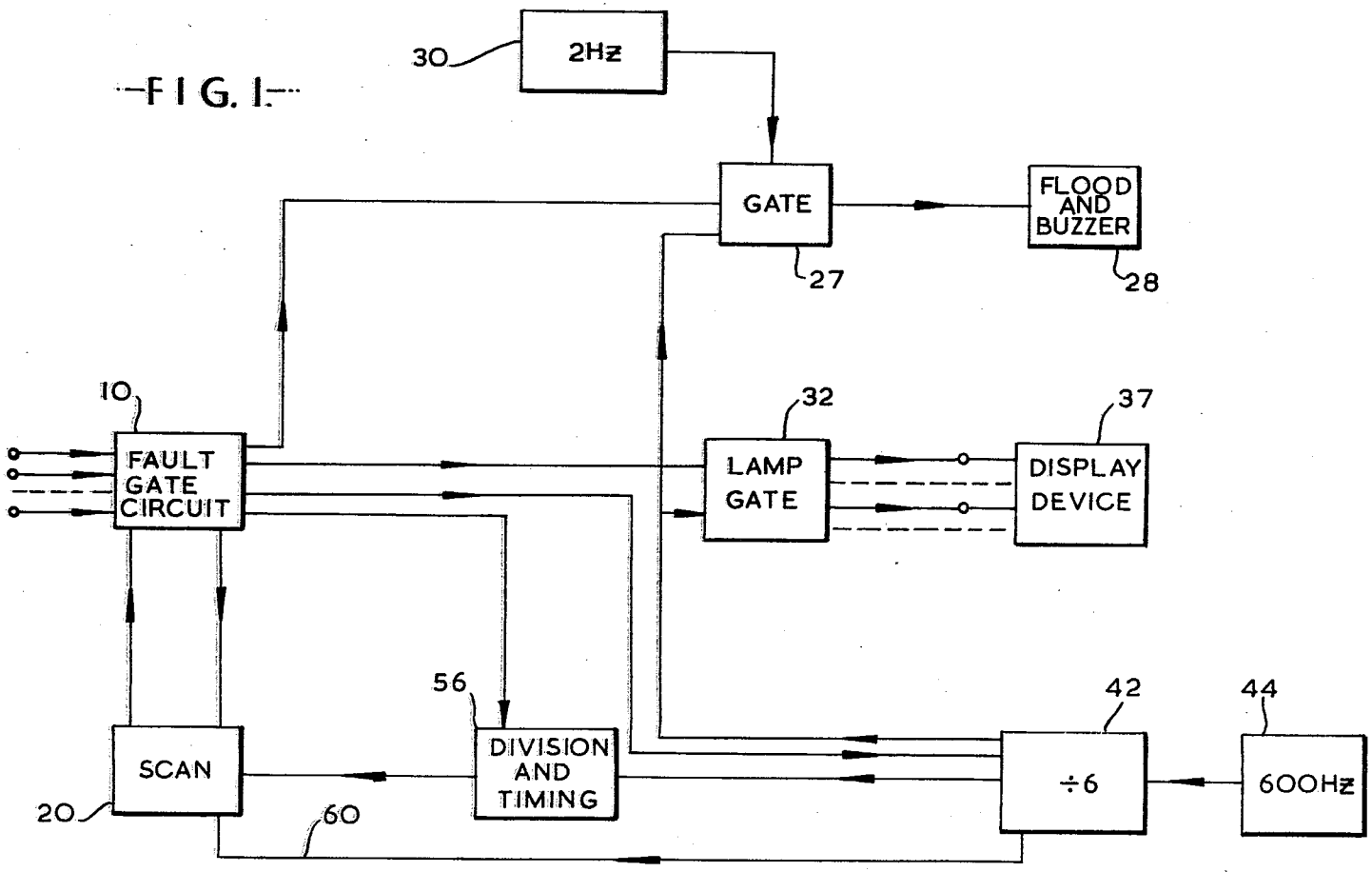
FIG. 1 is a block diagram of one embodiment of a sensor monitoring device in accordance with the present invention.
Figures 2A, 2B:
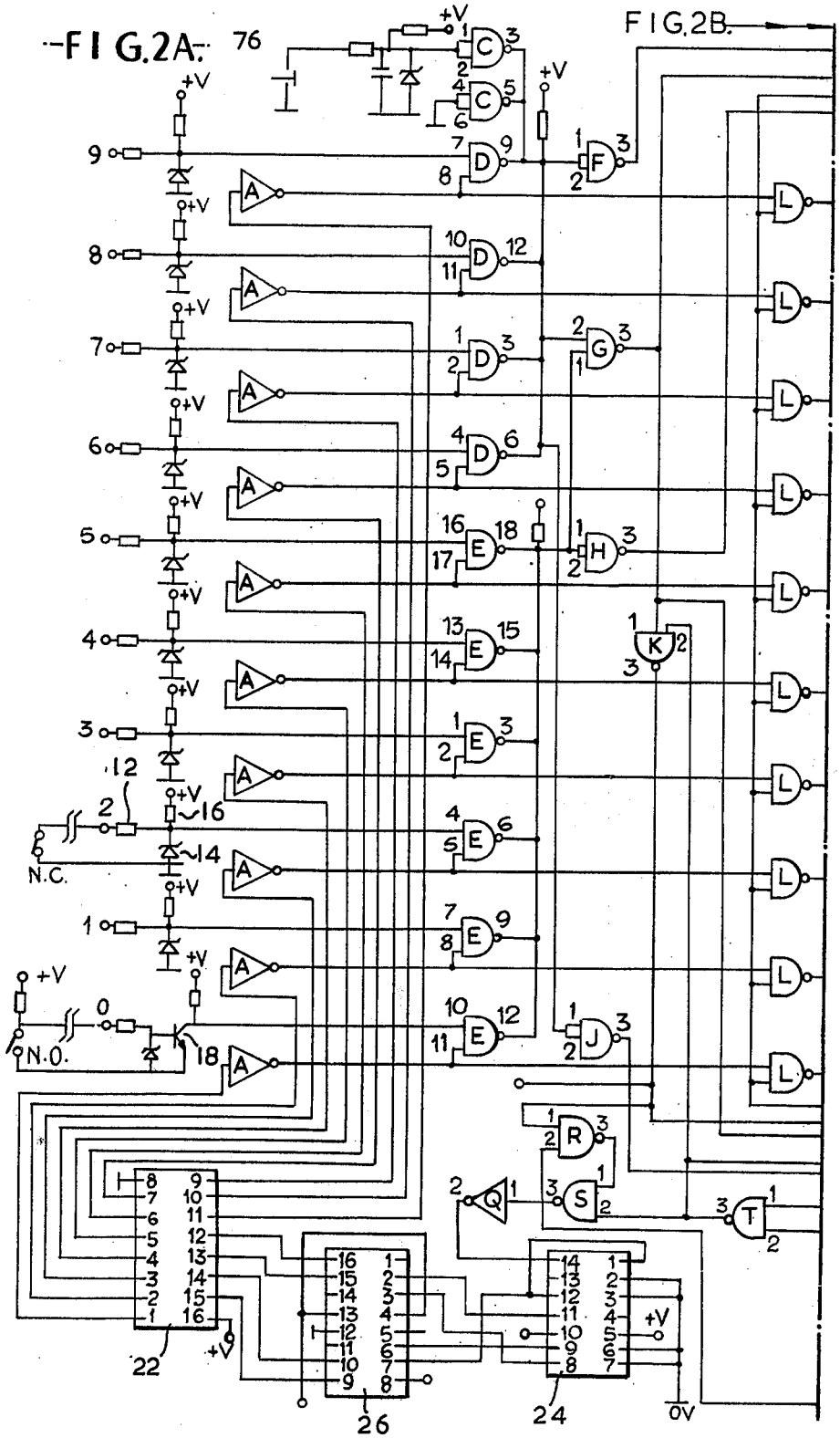
FIGS. 2A and 2B are a detailed circuit diagram of the embodiment of FIG. 1.
Figure 3:
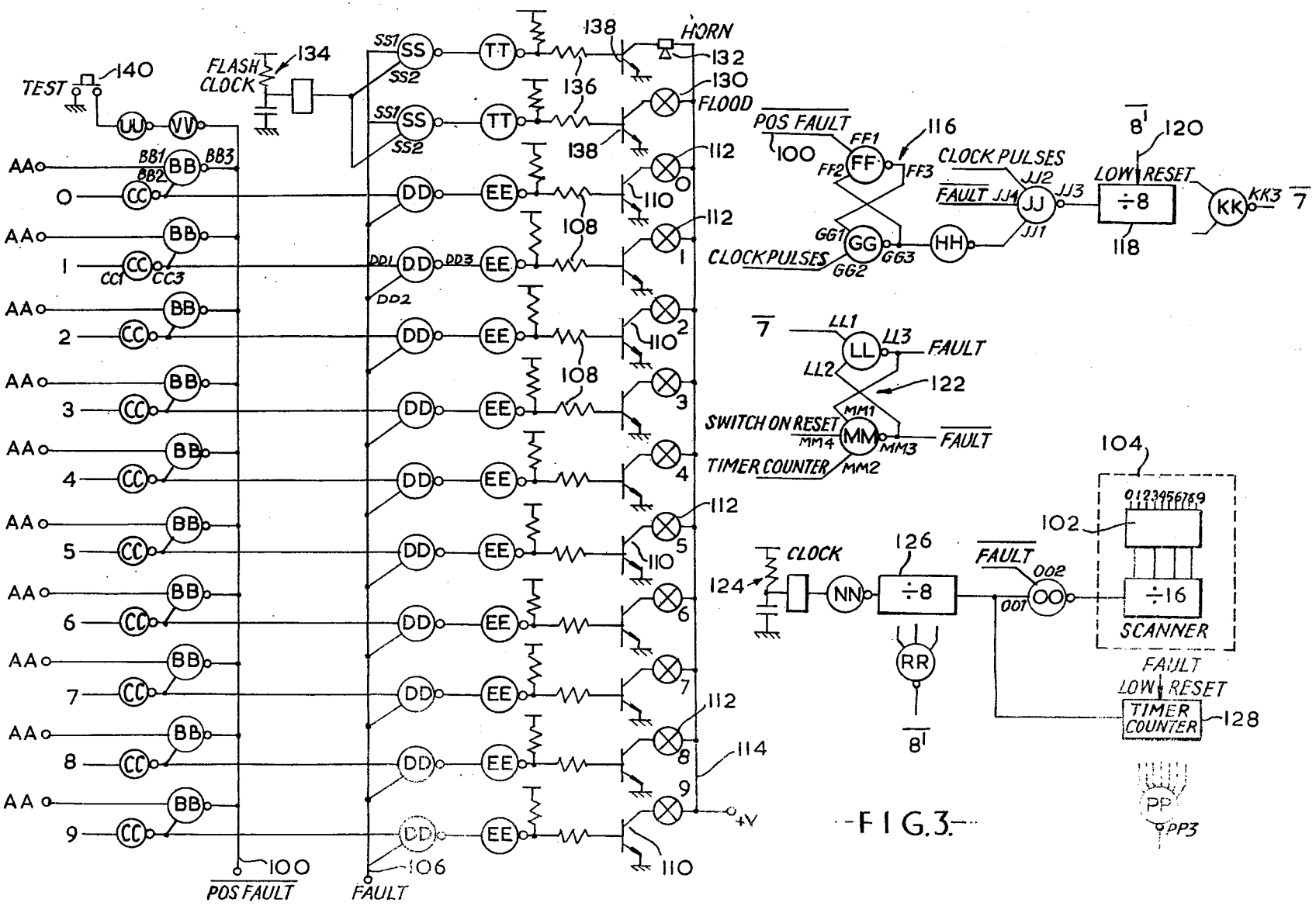
FIG. 3 is a schematic circuit diagram of the principal parts of a second embodiment of a sensor monitoring device in accordance with the invention.

The two monitoring devices illustrated in the drawings are intended to operate in conjunction with a display device of the type which comprises a plurality of converging, rear projection systems for projecting characters onto a single translucent screen, such that each displayed character occupies the whole, or substantially the whole, of the screen area (see U.K. Specifications Nos. 959,077 and 1,093,068). Each projection system includes its own light source, a collimating lens, a character forming mask and a condensing lens, arranged in that order from the light source. The monitoring circuits are intended to control the display device in accordance with information provided by a plurality of sensors which can be arranged to detect faults or other operating conditions in a machine or process being monitored. The embodiment illustrated in FIGS. 1, 2A and 2B are primarily intended for fault monitoring in transport vehicles, the sensors being adapted to be mounted at appropriate locations within the vehicle to monitor such parameters as oil pressure, water presence and temperature, battery charge, direction indicators, doors, rear lights, side lights, brake fluid, tyre pressures and the like. In the case of vehicles, the sensors might also be arranged to be in the form of detectors which are adapted to pick up hazard warning information from the road or track or from radio signals received from a distant transmitter. It will be appreciated, however, that the monitoring circuit of FIGS. 1, 2A and 2B could equally well be used to monitor the operating performance of almost any machinery or equipment which has variable operating parameters. The embodiment of FIG. 3 is particularly suited to this latter purpose.

The basic operation of the monitoring device of FIGS. 1, 2A and 2B, which is explained in detail below, can be described briefly as follows. When a sensor is actuated, the display device displays a suitable message or symbol. When two or more sensors are concurrently actuated, the appropriate messages are displayed consecutively and repetitively. Each individual message is displayed for a fixed period of time, after which it is either repeated or replaced by the next message if there is more than one. During the period of display, a coloured flashing "back-up" light is also energised and a buzzer is sounded.

In this embodiment, there are two possible "weights" of faults or information. Important (high priority) faults are displayed for a longer period, in this example for twice as long, than those of lesser importance (low priority), the former faults being backed by a red flashing light whilst secondary faults are backed by an amber flashing light. For example, a fault such as "low oil pressure" might be arranged to be a "high priority" fault, while "door not closed" might be a "low priority" fault.

The buzzer is operated at the same frequency as the flashing lights whenever a fault condition prevails, the buzzer being capable of being inhibited by an external switch if required.

Referring now to FIGS. 1, 2A and 2B, the monitoring device comprises a fault gating circuit 10 having, in this case, 10 inputs marked 0, 1, 2 . . . 9 for connection to respective parameter sensors. The inputs are designed to accept a fault signal from either a normally open (N.O) or a normally closed (N.C) contact. In the normally closed case (see input 2), the combination of an input resistor 12 and a zener diode 14 limits the maximum level of transient voltages possible at the input to the gate circuit 10. A pull-up resistor 16 maintains the gate input high in the event of a fault.

When the sensor is a normally open switch, an inverting transistor 18 is interposed between the switch contacts and the gate circuit 10 (see input 0). The transistor 18 is protected by the same input resistor, zener diode system as for normally closed conditions. In both N.O. and N.C. cases, a break in the input wire from the sensor results in a fault message being passed.

Figures 2A, 2B:
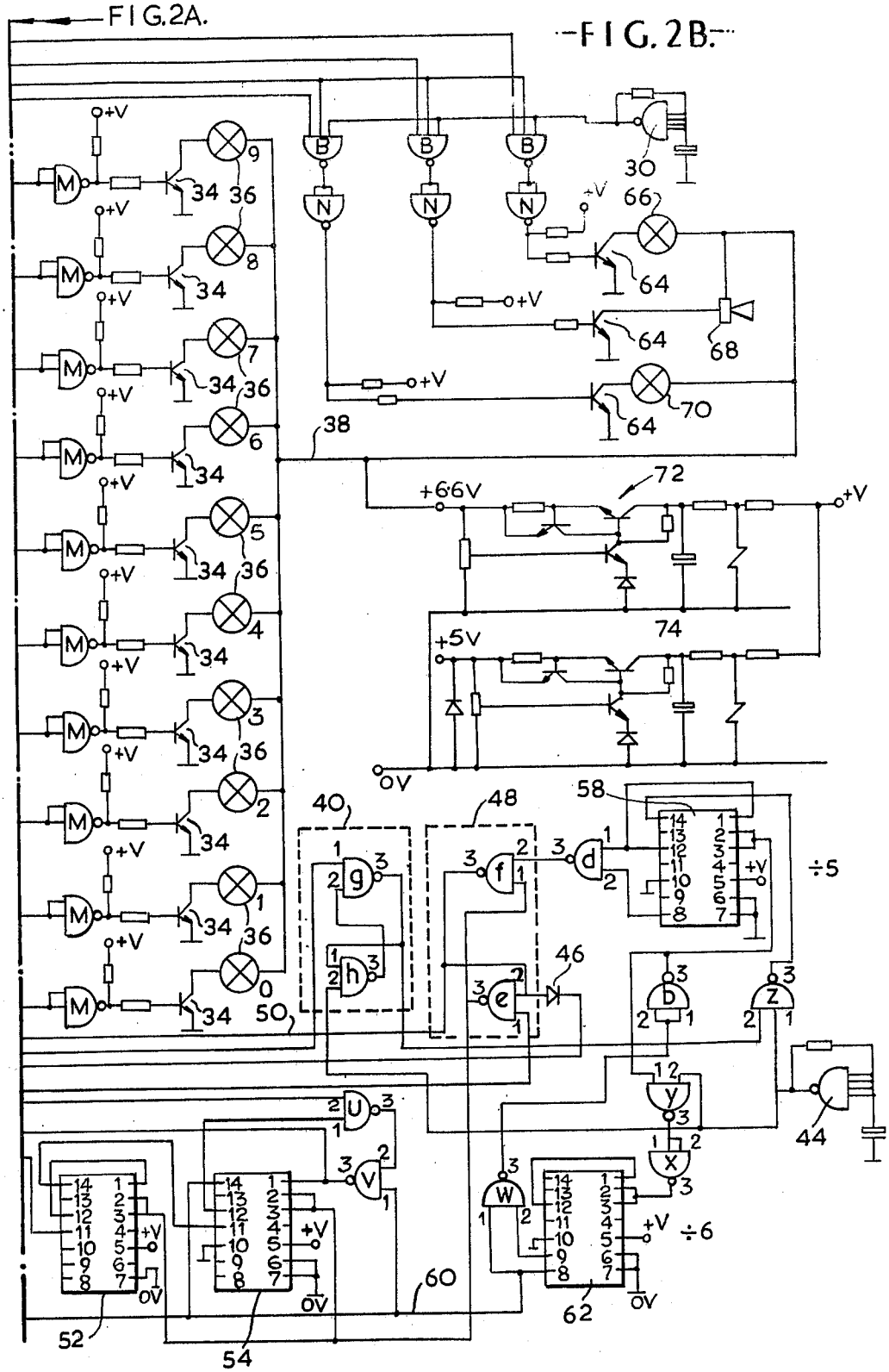

The fault gating circuit 10 includes two sets of NAND gates D,E, one input of the gates D being coupled to a respective one of the sensors associated with high priority faults and one input of the gates E being coupled to a respective one of the sensors associated with low priority faults. The second input of each of the gates D,E is connected to a respective output pin of a decimal decoder 22 (7442) via a respective amplifier A, the decoder 22 forming, together with a decade counter 24, a scanner 20. FIG. 2 does in fact also show the scanner to include a store 26(7475) but this is not always required and will not be described further.

The outputs of the NAND gates D are commonly connected firstly to an input $G_2$ of a NAND gate G, secondly to both inputs $J_1$ and $J_2$ of a NAND gate J, and thirdly to both inputs $F_1$ and $F_2$ of a NAND gate F. The output of the gate J is connected to an input $U_2$ of a NAND gate U.

The outputs of the NAND gates E are commonly connected to both inputs $H_1$ and $H_2$ of a NAND gate H and to an input $G_1$ of the NAND gate G.

The outputs of the gates F, G and H are respectively connected to first inputs of three NAND gates B forming a gating device 27 for a FLOOD and BUZZER circuit 28. Second inputs of the gates B are commonly connected to an oscillator 30 and third inputs of the gates B are commonly connected to first inputs of a plurality of NAND gates L forming part of a lamp gate control circuit 32. The number of gates L is equal to the number of sensor inputs, in this case ten, second inputs of these gates L being connected to the outputs of the amplifiers A, respectively. The outputs of the gates L are connected via further NAND gates M to respective driver transistors 34 each of which has a lamp 36 in its collector circuit connected to a positive voltage supply line 38. Each lamp 36 corresponds to one of the sensors and is adapted to display on the single screen a message or symbol representative of the associated fault condition. For example, if sensor 7 is actuated by a low oil pressure condition, then lamp 7 is arranged to illuminate a character mask or slide bearing the words "LOW OIL PRESSURE", of the like, when current is passed therethrough.

The output $G_3$ of NAND gate G is also connected to a first input $K_1$ of a NAND gate K, the output $K_3$ of which is connected to an input $R_1$ of a NAND gate R. The output $R_3$ of gate R is connected to an input $S_1$ of a NAND gate S whose output $S_3$ is connected to a clock input pin 14 of the decade counter 24 via an inverting amplifier Q.

The output $K_3$ of the NAND gate K is also connected to a SET input $g_1$ of a bistable 40 formed by a pair of NAND gates *g* and *h*. A second input $g_2$ of the gate *g* is connected to the output $h_3$ of the gate *h*. The output $g_3$ of the gate *g* is connected both to the input $h_1$ of the gate *h* and to an input $Z_2$ of a NAND gate Z forming part of a divide by six circuit 42. The second input $h_2$ of the gate *h* is connected to a main clock oscillator 44 providing, in this embodiment, clock pulses of 600 Hz.

The output $G_3$ of the NAND gate G is also connected, via a germanium diode 46 (1840), to an input $e_2$ of a NAND gate *e* which forms, together with a NAND gate *f*, a second bistable 48. An input $e_1$ of the gate *e* is connected both to an input $S_2$ of the gate S and to a second input $K_2$ of the gate K. The input $e_2$ of gate *e* is also connected both to the output $f_3$ of the gate *f* and to a line 50 commonly connected to second inputs of all of the NAND gates L of the lamp gate control circuit 32. The line 50 is also commonly connected to third inputs of the NAND gates B of the FLOOD and BUZZER circuit 28. The output $e_3$ of the gate *e* is connected both to an input $f_1$ of the gate *f* and to pins 2 and 3 on two counters 52 and 54 of a division and timing circuit 56.

A second input $f_2$ of the gate *f* is connected to the output $d_3$ of a NAND gate *d* whose first input $d_1$ is connected to pins 1 and 12 of a divide by five counter 58 (7490) forming part of the divide by six circuit 42, and whose second input $d_2$ is connected to pin 8 of the counter 58. A second input $Z_1$ of the gate Z is connected to the main clock oscillator 44 and the output $Z_3$ of this gate Z is connected to a clock input pin 14 of the counter 58.

A second input $R_2$ of the NAND gate R is connected to a line 60 carrying a clock signal for the scanner 20 from pin 8 of an individual divide by six counter 62 forming part of the divide by six circuit 42. The line 60 is also connected to pin 14 of counter 54, to a first input $V_1$ of a NAND gate V and to a first input $W_1$ of a NAND gate W.

The input $S_2$ of gate S is also connected to the output $T_3$ of a NAND gate T having a first input $T_1$ connected to the output $V_3$ of the gate V and a second input $T_2$ connected to pin 11 of the counter 52. The output $V_3$ of the gate V is also connected to pin 1 of the counter 54. An input $V_2$ of gate V is connected to the output $U_3$ of the gate U, the latter gate U having a further input $U_1$ connected to pin 12 of the counter 54. Pins 1 and 12 of counter 52 are connected together and pin 14 of counter 52 is connected to pin 11 of counter 54.

The inputs $b_1$ and $b_2$ of a further NAND gate *b* are both connected to the output $W_3$ of the gate W, the output $b_3$ of gate *b* being connected both to pins 2 and 3 of counter 58 and to an input $Y_1$ of a NAND gate Y. A second input $Y_2$ of gate Y is connected to the main clock oscillator 44. The output $Y_3$ of gate Y is commonly connected to two inputs $X_1$ and $X_2$ of a NAND gate X whose output $X_3$ is connected to pins 2 and 3 of counter 62. The other input $W_2$ of NAND gate W is connected to pin 9 of counter 62.

The outputs of the gates B of the FLOOD and BUZZER circuit 28 are respectively connected, via NAND gates N, to transistors 64 controlling a flood lamp 66, a buzzer 68 and a flood lamp 70, the arrangement being such that the buzzer 68 is actuated whenever a fault is detected, the lamp 66 being flashed (red) whenever a high priority fault is detected, and the lamp 70 being flashed (amber) whenever a low priority fault is detected.

The line 38 is connected to a stabilised d.c. power supply 72, a separate stabilised d.c. power supply 74 being provided for the T.T.L. circuitry.

The above described monitoring circuit operates as follows.

Under no-fault conditions, the fault gating circuit 10 is scanned by the scanner 20, the scanner 20 being arranged to be clocked at one sixth the frequency (100 Hz) of the main clock oscillator 44 (600 Hz) via the divide by six counter 62 and the line 60, the scanner 20 then producing every hundreth of a second a sequence of pulses which are applied via the amplifiers A to the second inputs of the NAND gates D and E of the fault gating circuit 10 and to the second inputs of the NAND gates L of the lamp gate circuit 32. Since no fault is present, however, the lamps 36 of the display device, identified in FIG. 1 by reference numeral 37, remain unlit due to the NAND gates L of the lamp gate circuit 32 being blocked by the absence of a signal on the line 50.

When a fault signal occurs on one of the inputs 0 to 9, a signal is applied to the input of the corresponding one of the NAND gates D or E. The incidence of an output pulse from the scanner 20 at the second input of that particular gate allows the gate to change state and provide an output signal which is applied via gate G and gate K to input $R_1$ of gate R such as to close the gate R and so prevent the clock signal entering on $R_2$ from reaching the decade counter 24. The scanner 20 is thereby inhibited and the scan stops at the gate D or E associated with the fault.

The main clock oscillator 44 is continuously free-running at 600 Hz during operation of the circuit and is arranged to maintain the bistable 40 formed by the NAND gates *g* and *h* in a first operating state in the absence of a signal at input $g_1$, corresponding to a fault signal at $G_3$. In the absence of such a signal at $g_1$, the NAND gate Z is also blocked so that the divide by five counter 58, forming part of the divide by six counter 42, is disconnected from energising pulses from the main clock oscillator 44 arriving at input $Z_1$. When no fault signal is present, the bistable 48 formed by the NAND gates *e* and *f* is arranged to be in a first operating state which maintains the NAND gates L of the lamp gate circuit 32 blocked via $f_3$ and the line 50 and which also inhibits, via $e_3$, the counters 52,54 of the division and timing circuit 56, the division and timing circuit 56 being provided for determining the display time of the or each fault message.

When a fault occurs, a fault signal occurs at $K_3$, as a result of a signal at $G_3$, and sets the bistable 40, which is used to prevent noise spikes from triggering the divide by five counter 58, into its second state so as to open the NAND gate Z and allow clock pulses (600 Hz) from the main clock oscillator 44 to reach the divide by five counter 58. The clock pulses are also applied to $h_2$ of bistable 40 so that each clock pulse resets the bistable 40 and therefore blocks the gate Z if the fault signal is no longer present. If, however, the fault remains, the bistable 40 remains set and the counter 58 is arranged to produce one output pulse after five input clock pulses from the main oscillator 44, this output pulse triggering the bistable 48 into its second operating state which therefore opens the appropriate one of the NAND gates L via $f_3$ and the line 50 whereby to energise the message illuminating lamp 36 corresponding to the fault detected. At the same time, the bistable 48 removes the inhibit on the counters 52,54 via $e_3$.

The frequency of the main clock oscillator 44 (600 Hz) is chosen such that transient noise on the fault inputs will not exist long enough to allow the bistable 40 to remain set and allow the counter 58 to count to the fifth pulse. Thus, only real fault signals are allowed to set the display enabling bistable 48.

The individual divide by six counter element 62 of the divide by six circuit 42 is arranged to reset and so clear any noise information on the divide by five counter 58 every sixth pulse from the main clock oscillator 44 so that counter 58 effectively operates as a divide by six network and provides a system clock frequency of 100 Hz which is applied via bistable 58 to pins 3 of the counters 52,54 of the division and timing circuit 56. The latter counters 52,54 are responsible for defining the display time of each message being indicated.

As mentioned above, the monitoring circuit is arranged to be able to distinguish between high and low priority faults and to control the display time of the message accordingly. The path of a low priority and a high priority fault signal will now be followed through the circuit separately to illustrate the manner in which the display time of each is distinguished.

When no fault or a low priority fault is present, a permanent "low" signal is maintained at the output $U_3$ of the NAND gate U in the division and timing circuit 56, the latter signal being applied to input $V_2$ of the NAND gate V. When a low priority fault is present, therefore, the 100 Hz system clock signal, which appears on pin 8 of the divide by six counter 62, is applied to $V_1$ and hence via $V_3$ to pin 1 of the counter 54. This input is arranged to cause counter 54 to divide by five so that a 20 Hz signal is applied to pin 14 of the counter 52.

After eight input pulses, the counter 52 is arranged to provide one output pulse at its pin 11 which pulse is then applied to input $T_2$ of the gate T, the counter 52 thus acting as a divide by eight element to provide a $2\frac{1}{2}$ Hz signal at its output pin 11. The output on $V_3$ is also applied to input $T_1$ so that, when $V_3$ next goes "high," $T_3$ goes "low," $K_3$ goes "high," $R_3$ goes "low," $S_3$ goes "high," and thus $Q_2$ goes "low" to provide a signal at pin 14 of counter 24 which recommences the scanning action of the scanner 20. $G_3$ immediately goes "low" and resets the bistable 48 via the germanium diode 46 so as to switch off the gates L. If this were not done, the scanner would energise each lamp 36 in turn when scanning. The resetting of bistable 48 also resets and inhibits the counters 52,54, the output on pin 11 of counter 52 going low. The bistable 40 is reset by the main clock oscillator 44.

The circuit is then in a "reset" condition and awaiting the next fault signal to be scanned.

The circuit responds in a similar manner to a high priority fault with the difference that $J_3$ goes "high" and enables gate U, the normal divide by two function of the decade counter 24 then being effective in addition to the divide by five function so that a complete division by ten is achieved in the counter 24 producing double the display time for the fault message.

When a fault is removed during the display time, $G_3$ goes "low" and resets the bistable 48 via the diode 46.

As mentioned above, if this were not done, the output gates L would remain enabled until the display time counters 52,54 gave their output. The scan inputs would therefore pass through the output gates and cause the message indicating lamps 36 to flicker in sympathy.

As described initially, the circuit includes two "back-up" lamps 66,70 and a buzzer 68 which are energised during display. When an input fault signal is present, $F_3$ goes "high" for a high priority fault and $H_3$ for a low priority fault to energise the red or amber "back-up" lamp or flood 66,70 respectively. A common signal from $G_3$, independently of whether the fault is of high or low priority, actuates the circuits of the buzzer 68, both the buzzer and the "back-up" lamps being modulated at a frequency of approximately 2 Hz by the oscillator 30, when activated.

The circuit also includes an "integrity test" function which, when operated, applies a permanent signal to $D_9$ to cause all the fault messages to be displayed sequentially. The "integrity test" signal is applied to $D_9$ via the output $C_3$ of a NAND gate C to which an input signal is applied by actuation of a push-button 76.

FIG. 3 illustrates a second sensor monitoring circuit embodying the invention. The embodiment of FIG. 3 includes a number of inputs AA, in this case 10, for connection to respective sensors (not shown), which, in this embodiment, are intended to detect fault conditions in a machine or vehicle. Each input AA is connected to a first input $BB_1$ of a respective NAND gate BB, the outputs $BB_3$ of which are commonly connected to a line 100 which is to carry a signal indicative of there being a fault or a possible fault and is therefore referred to as the $\overline{\text{POS FAULT}}$ line.

The other inputs $BB_2$ of the gates BB are respectively connected to the outputs $CC_3$ of ten NAND gates CC whose inputs $CC_1$ are connected to respective lines marked 0 to 9. The latter lines are connected to correspondingly marked output lines of a decoder 102 forming part of a scanner 104.

The outputs $CC_3$ of the gates CC are also respectively connected to first inputs $DD_1$ of 10 NAND gates DD, whose other inputs $DD_2$ are commonly connected to a line 106 which is to be supplied with a signal indicative of there actually being a fault in existence when the latter condition has been verified by another part of the circuit described hereinafter. The line 106 is therefore referred to as the FAULT line.

The outputs $DD_3$ of the gates DD are connected via respective NAND gates EE and resistors 108 to the bases of ten transistors 110, the collectors of which are connected via respective lamps 112 (marked 0 to 9) to a common positive supply line 114. Each lamp 112 corresponds to one of the sensors and is adapted, as in the first embodiment, to display on a single screen a message or symbol representative of the associated fault condition when that fault condition has been verified.

The $\overline{\text{POS FAULT}}$ line 100 is connected to one input $FF_1$ of a NAND gate FF which, together with a NAND gate GG, forms a first bistable 116. The output $FF_3$ of the gate FF is connected to an input $GG_1$ of the gate GG and the output $GG_3$ of the gate GG is connected to a second input $FF_2$ of the gate FF. The output $GG_3$ of the gate GG is also connected by a NAND gate HH to one input $JJ_1$ of a NAND gate JJ, whose output $JJ_3$ is connected to the input of a divide by eight counter 118. The counter 118, which is referred to as the fault integrity counter, is arranged to supply an output pulse at the output $KK_3$ of a decoding NAND gate KK when the input to the counter 118 has received seven pulses before the counter 118 has been reset by the arrival of a signal on a RESET line 120.

The output $KK_3$ ($\bar{7}$) is connected to a first input $LL_1$ of a NAND gate LL which, together with a NAND gate MM, forms a fault-latch bistable 122. The output $LL_3$ of the gate LL is connected to a first input $MM_1$ of the gate MM and the output $MM_3$ of the gate MM is connected to a second input $LL_2$ of the gate LL. The output $LL_3$ of the gate LL provides the FAULT signal for application to the FAULT line 106 when the bistable 122 is SET. The output $MM_3$ of the gate MM provides a signal referred to as $\overline{\text{FAULT}}$ (i.e. the inverse of FAULT) when the bistable 122 is in its RESET state.

A main clock oscillator 124 is connected via a NAND gate NN to the input of a second divide by eight counter 126 which provides an output pulse at every eighth clock pulse, the output pulses from the counter 126 being supplied to the input of the scanner 104 by way of a NAND gate OO. A second input $OO_2$ of the gate OO is connected to the $\overline{\text{FAULT}}$ output $MM_3$ of the bistable 122. The output of the counter 126, which is connected to the first input $OO_1$ of the gate OO, is also connected to the input of a timer counter 128 which is arranged to produce, on the output $PP_3$ of a NAND gate PP an output pulse after a predetermined number of input pulses have been counted. The output $PP_3$ is connected to a second input $MM_2$ of the gate MM in the bistable 122 for resetting this bistable 122 at the end of the count period of the timer counter 128. The timer counter 128 has a RESET input connected to the FAULT output $LL_3$ of the bistable 122.

A third input $MM_4$ of the gate MM is arranged to provide a RESET signal for the bistable 122 when the circuit is first switched on.

Clock pulses from the main clock oscillator 124 are supplied to a second input $GG_2$ of the gate GG in the bistable 116 and also to a second input $JJ_2$ of the gate JJ. A third input $JJ_4$ of the gate JJ is connected to the $\overline{\text{FAULT}}$ output $MM_3$ of the bistable 122. A RESET signal for the counter 118 is obtained every eight clock pulses from the divide by eight counter 126 via a NAND gate RR.

An additional circuit portion is provided for energising a FLOOD lamp 130 and a horn or buzzer 132 whenever a fault condition on any of the sensors has been verified. This circuit portion includes a pair of NAND gates SS whose one inputs $SS_1$ are connected to the FAULT line 106 and whose second inputs $SS_2$ are connected to a secondary clock oscillator 134. The outputs of the gates SS are respectively connected, via NAND gates TT and resistors 136, to transistors 138, the collectors of which are respectively connected to the positive supply line 114 via the FLOOD lamp 130 and the horn 132.

Finally, a circuit test button 140 is provided which is connected to the $\overline{\text{POS FAULT}}$ line 100 via series connected NAND gates UU and VV.

The second embodiment operates as follows.

When no fault condition exists, there is no SET signal on the $\overline{\text{POS FAULT}}$ line 100 for the bistable 116 so that the latter bistable remains in its RESET state. Every eighth pulse from the continuously operating main clock oscillator 124, the divide by eight counter 126 supplies an input pulse to actuate the scanner 104. In this particular embodiment, the scanner has sixteen steps, the first ten of which are decoded and sequentially enable the inputs 0 to 9, while the remainder of the steps are ignored. The divide by eight counter 126 also provides a signal (via $\overline{8}'$) for resetting the fault integrity counter 118 each time the scanner steps on. The fault latch bistable 122 therefore remains reset so that a FAULT signal is absent on the line 106 and the gates DD controlling the lamps 112 are therefore inhibited. The timer counter 128 is also held in its reset state.

When a signal appears on one of the sensor inputs AA, for example sensor 4, a corresponding input signal is applied to the input $BB_1$ of the associated gate BB. On the incidence of a scanning pulse at the other input $BB_2$ of that gate BB via the corresponding one of the lines 0 to 9 and gate CC, a signal appears on the $\overline{\text{POS FAULT}}$ line 100. At the same time, the scanning signal on the line 4 is applied via the gate CC to the corresponding lamp control gate DD but the associated lamp remains unlit due to the continued presence of the inhibit signal on the FAULT line 106.

The signal on the $\overline{\text{POS FAULT}}$ line 100 is applied to input $FF_1$ to set the bistable 116 and thus enable the path of clock pulses to the fault integrity counter via gate JJ. The next clock pulse arriving at $GG_2$ resets the bistable 116. If the fault input at AA is still present so that a signal remains on the $\overline{\text{POS FAULT}}$ line 100, the bistable 116 is set again when the clock pulse goes "high" whereby another clock pulse passes to the integrity counter via gate JJ.

The arrangement is such that if the fault integrity counter 118 does not reach a count of seven before the scanner 104 steps on, the counter 118 is reset via $\overline{8}'$ (line 120) and the possible fault is ignored without the corresponding lamp ever having been activated.

If, however, the fault integrity counter 118 reaches a count of seven before the scanner steps on, a signal appears on the output of gate KK ($\overline{7}$) and the fault-latch bistable 122 is set. A $\overline{\text{FAULT}}$ signal thus appears on the output $MM_3$ which is applied both to the gate OO to stop the scanner 104 and also to the FAULT line 106 to enable the appropriate gate DD (whose other input is still activated by the scanning signal) and hence activate the corresponding lamp, in this case lamp 4. At the same time, the inhibit is removed from the timer counter 128 so that the latter element starts counting. As soon as a signal appears on FAULT line 106, both the FLOOD lamp 130 and horn 132 are actuated by the clock 134.

The activated lamp 112 stays on until the timer counter has reached a predetermined count. The main clock frequency and count setting of the counter 128 are chosen such that the lamp 112 is energised for a desired period, for example for two seconds. At the end of that time, a signal is arranged to appear on output $PP_3$ of gate PP which is applied to input $MM_2$ of fault latch bistable 122 to reset this element. The timer counter 128 is thereby reset, the fault integrity counter 118 is enabled via $JJ_3$, the FAULT signal is removed from line 106 to extinguish the lamp 112 and the scanner 104 is enabled via $OO_2$ whereby normal scanning is resumed until the next possible fault condition occurs.

By virtue of the provision of the fault integrity test, the circuit is able to distinguish between true faults which result in a continuous input signal at one or more of the inputs AA and transient signals at these inputs caused, for example, by noise in the sensor circuits. The latter signals, although tripping the input gates BB and resulting in a $\overline{\text{POS FAULT}}$ signal on line 100 are ultimately rejected by the fault integrity circuit without any lamp 112 being misleadingly energised.

Closure of the test switch 140 causes a signal to be permanently applied to the $\overline{\text{POS FAULT}}$ line 100 until the switch 140 is re-opened, the lamps 112 being sequentially energised for the period set by the timer counter 128 to indicate whether the circuit is functioning correctly.

We claim:

1. In a monitoring device for monitoring the outputs of a plurality of sensors and displaying appropriate information, said device comprising:

a plurality of input gate circuits for connection to the plurality of sensors;

scanning means operatively coupled to said input gate circuits and adapted to sequentially scan said input gate circuits to detect the presence of any activated sensor and to open any scanned gate which has an input signal during the period it is being scanned;

a plurality of display devices for sequentially displaying information corresponding to any activated sensor, said display devices including lamps controlled by respective lamp gate circuits;

a timing circuit for controlling the display time of the display devices; the improvement comprising an integrity circuit operatively coupled to said input gate circuits and to said display devices and adapted to inhibit the actuation of all of the display devices for a predetermined period following detection of an activated sensor.

2. A monitoring device for monitoring the outputs of a plurality of sensors and displaying appropriate information, said device comprising:

a plurality of input gate circuits for connection to the plurality of sensors;

scanning means operatively coupled to said input gate circuits and adapted to sequentially scan said input gate circuits to detect the presence of any activated sensor and to open any scanned gate which has an input signal during the period it is being scanned;

a plurality of display devices for sequentially displaying information corresponding to any activated sensor, said display devices including lamps controlled by respective lamp gate circuits;

a timing circuit for controlling the display time of the display devices;

an integrity circuit operatively coupled to said input gate circuits and to said display devices and adapted to inhibit the actuation of all of said lamp gate circuits for a predetermined period following detection of an activated sensor; said integrity circuit including a source of clock pulses;

a first counter;

a first bistable device responsive to the opening of any of said input gates to enable clock pulses from said clock pulse source to reach said first counter; and a second bistable device which is adapted to be operated by said first bistable device to remove the inhibit from said lamp gate circuits and to actuate said timing circuit, when a predetermined number of clock pulses has reached said first counter.

3. A monitoring device according to claim 2 in which the first bistable device is adapted to be reset by successive clock pulses whereby to inhibit the passage of further clock pulses to said first counter in the event that the input gate has reclosed in the meantime by reason of the disappearance of the signal at the input thereof.

4. A monitoring device according to claim 3 including further gate means responsive to the opening of any of said input gates to stop said scanning means, such that a scanning signal remains on that input gate.

5. A monitoring device according to claim 3 in which the operation of said second bistable device is also adapted to stop said scanning means, such that a scanning signal remains on that input gate which triggered the operation of said first bistable device.

6. A monitoring device according to claim 4 in which said timing circuit activates said display devices to display the information corresponding to different ones of said sensors for different predetermined periods.

7. A monitoring device according to claim 4 further comprising a flood lamp which is activated at the end of said predetermined period of inhibition of the display devices and remains activated until there is no longer any activated sensor.

8. A monitoring device for monitoring the outputs of a plurality of sensors and displaying appropriate information, said device comprising:

a plurality of input gate circuits for connection to the plurality of sensors;

scanning means operatively coupled to said input gate circuits and adapted to sequentially scan said input gate circuits to detect the presence of any activated sensor and to open any scanned gate which has an input signal during the period it is being scanned;

a plurality of display devices for sequentially displaying information corresponding to any activated sensor, said display devices including lamps controlled by respective lamp gate circuits;

a timing circuit for controlling the display time of the display devices, said timing circuit being arranged to activate the display devices to display the information corresponding to different ones of the sensors for different predetermined periods;

an integrity circuit operatively coupled to said input gate circuits and to said display devices and adapted to inhibit the actuation of all of said lamp gate circuits for a predetermined period following detection of an activated sensor; said integrity circuit including a source of clock pulses;

a first counter;

a first bistable device responsive to the opening of any of said input gates to enable clock pulses from said clock pulse source to reach said first counter; and a second bistable device which is adapted to be operated by said first bistable device to remove the inhibit from said lamp gate circuits and to actuate said timing circuit, when a predetermined number of clock pulses has reached said first counter; and said timing circuit including a second counter which is arranged to receive pulses at a rate corresponding to a fraction of the clock pulse frequency when said second bistable device has been operated and to reset said second bistable device to reapply the inhibit on said lamp gate circuits when its count has been completed, and further gating means which select the count at which said second counter responds in dependence upon which of said input gates has been closed.

9. A monitoring circuit for monitoring the outputs of a plurality of sensors and displaying appropriate information, comprising a plurality of input gates for receiving output signals from the plurality of sensors, scanning means operatively associated with said input gates and adapted to sequentially scan the input gates and to open any scanned gate which is simultaneously receiving a signal from a sensor, a plurality of lamp gates, a plurality of display lamps controlled by respective ones of said lamp gates for displaying information corresponding to the sensors, a timing circuit operatively associated with the lamp gates for controlling the display time of the lamps, and a fault integrity circuit for inhibiting the actuation of all of the lamp gate circuits for a predetermined period following detection of a sensor signal whereby to ensure that only real sensor signals result in a corresponding display lamp being activated.

10. In a monitoring device for monitoring the outputs of a plurality of sensors and displaying appropriate information, the combination of:

clock means for producing clock signals of fixed frequency;

a plurality of input gates for receiving output signals from a plurality of sensors;

scanning means adapted to receive said clock signals for sequentially scanning said input gates and inhibiting means connecting said clock means to said scanning means and actuated in response to a fault indicating output from an input gate being scanned for inhibiting further scanning by said scanning means;

a plurality of display means, one associated with each of said input gates, for providing displays indicative of faults detected by said input gates;

delay means actuated by said fault indicating output from the input gate being scanned for enabling said display means only after a first predetermined time delay subsequent to said fault indicating output;

actuating means for actuating that display means associated with said input gate being scanned for a second predetermined time delay subsequent to said first time delay to cause display of information during said second time delay; and means for resuming said sequential scanning upon termination of said second time delay.

11. In a monitoring device as defined in claim 10 wherein said delay means comprises counter means which counts a predetermined number of said clock signals to establish said first time delay.

12. In a monitoring device as defined in claim 11 wherein said actuating means comprises counter means which counts a predetermined number of said clock signals to establish said second time delay.

13. In a monitoring device as defined in claim 10 including priority means connected with certain of said input gates for establishing high priority therefor; said actuating means being connected with said priority means to actuate that display means associated with a high priority input gate being scanned for a third predetermined time delay which is greater than said second time delay.

14. In a monitoring device as defined in claim 13 wherein said actuating means comprises first counter means for counting a predetermined number of said clock signals to establish said second time delay and second counter means for counting a predetermined number of said clock signals to establish said third time delay.

* * * * *

UNITED STATES PATENT AND TRADEMARK OFFICE

CERTIFICATE OF CORRECTION

PATENT NO. : 4,092,642

DATED : May 30, 1978

INVENTOR(S) : Douglas Harry Green et al

It is certified that error appears in the above-identified patent and that said Letters Patent are hereby corrected as shown below:

[73] Assignee: DELPHIC LIMITED,
Douglas, Isle of Man, the United Kingdom

Signed and Sealed this

***Twenty-seventh* Day of *March 1979***

[SEAL]

*Attest:*

RUTH C. MASON
*Attesting Officer*

DONALD W. BANNER
*Commissioner of Patents and Trademarks*